United States Patent [19]

Brendle

[11] 4,450,775

[45] May 29, 1984

[54] MERCHANDISE DISPLAY DEVICE

[76] Inventor: David A. Brendle, 525 E. Bluebonnet La., Hoffman Estates, Ill. 60195

[21] Appl. No.: 458,661

[22] Filed: Jan. 17, 1983

[51] Int. Cl.[3] ..... A47B 47/00

[52] U.S. Cl. ..... 108/64; 211/191; 211/134; 108/107

[58] Field of Search ..... 211/187, 186, 191, 190, 211/189, 134; 108/64, 107; 312/111, 263

[56] References Cited

U.S. PATENT DOCUMENTS

| | | | |
|---|---|---|---|
| 1,064,737 | 6/1913 | Jamison | 108/64 |
| 2,343,832 | 3/1944 | Pinson | 108/64 X |
| 3,001,687 | 7/1959 | Eifrid | 312/111 X |
| 3,517,826 | 1/1968 | Schafer | 211/134 |
| 3,971,477 | 7/1976 | Bruderly | 108/64 X |

FOREIGN PATENT DOCUMENTS

| | | | |
|---|---|---|---|
| 1210585 | 9/1959 | France | 211/187 |
| 1359212 | 3/1964 | France | 108/64 |
| 141908 | 9/1953 | Sweden | 211/187 |

*Primary Examiner*—Ramon S. Britts
*Assistant Examiner*—Blair M. Johnson
*Attorney, Agent, or Firm*—Oldham, Oldham, Hudak, Weber & Sand

[57] ABSTRACT

A device constructed of prefabricated materials which can be used for display of merchandise and/or printed materials in stores, malls and the like. Modular construction permits tailoring the size of the display according to individual needs. In one embodiment of the device, pairs of uprights are attached by means of a novel retainer clip which allows the insertion of a panel between the upright pairs. The resulting structure is extremely rigid, yet can easily be assembled and disassembled without the services of a carpenter.

3 Claims, 9 Drawing Figures

MERCHANDISE DISPLAY DEVICE

TECHNICAL FIELD

The invention lies in the art of display structures. In particular, the invention relates to the field of portable frames which can be assembled and disassembled on site and which can be used for the storage and display of saleable items such as those found in department stores, grocery stores, and the like.

BACKGROUND ART

To those well versed in the art of merchandizing, it has long been known that the prominent display of items for sale is an effective means for inducing customers to make purchases. Display racks have often been used for this purpose consisting of shelving secured to some form of support structure. Heretofore, the use of shelving has required the services of a carpenter who builds the supporting structure on site. Use of on site construction has been necessitated by reason of the custom requirements of each individual installation and due to the awkwardness of transporting an already assembled unit to the point of display.

This prior art method has several drawbacks. First, there is the initial expense of construction which may be considerable depending on the complexity of the particular structure. Second, mistakes are inevitably made in construction, resulting in an uneven or non-level structure which may detract from the overall appearance. Third, great expense is incurred in dismantling the structure when rearranging the form of the display. This last drawback is particularly troublesome in those areas of marketing which have a high product turnover necessitating frequent changes in both the style of the display and the merchandise contained therein.

Thus it can be seen that there is a need in the art for a method of display which will substantially reduce the cost of construction and dismantling as well as allow a greater degree of flexibility in tailoring the appearance to fit a particular situation. This need is met by the instant invention.

DISCLOSURE OF THE INVENTION

It is accordingly an aspect of the invention to provide a merchandise display device which can be assembled from standardized, precut pieces.

Another aspect of the invention is to provide a merchandise display device, as above, which is modular, permitting use in a variety of custom installations.

Yet another aspect of the invention is to provide a merchandise display device, as above, which does not require the services of a carpenter for installation.

Still another aspect of the invention is to provide a merchandise display device, as above, which can be disassembled and reassembled easily.

Yet another aspect of the invention is to provide a merchandise display device, as above which can also serve as a means of storage of items.

Yet another aspect of the invention is to provide a merchandise display device, as above, which also provides a means for display of advertising material.

These aspects, as well as others which will become more apparent through a reading of the following detailed description, are acheived by: a display device, comprising: at least four pairs of upright members, each pair having two uprights adjoined by braces, each said upright having a groove along its inner edge; a plurality of retainer clips securing said upright pairs in series fashion, forming thereby two units of two pairs each; a gondola cap joining said units in parallel array and having a tang at each end thereof friction fitted into the said grooves of said uprights joined by said retainer clips; at least a shelf secured in horizontal fashion to one of said braces in each of said units. A retainer clip, comprising: a base section; a retention bracket connected to said base by means of a spacing bar, said spacing bar creating a gap between said base and said retention bracket; wherein said retainer clip is used to secure upright members and wherein said gap receives a panel. A display device, comprising: at lease three pairs of upright members, each pair having two uprights joined by braces, each said upright having a groove along its inner edge; at least a shelf connecting said pairs of uprights and having end brackets in communication with said grooves; an angled section secured to one said upright in each said pair; and a display surface frictionally disposed between said shelf and said angled section.

BRIEF DESCRIPTION OF THE DRAWINGS

To more fully understand the invention, a reading of the detailed description should be accompanied by reference to the drawings, wherein.

BEST MODE FOR CARRYING OUT THE INVENTION

Figure 1:
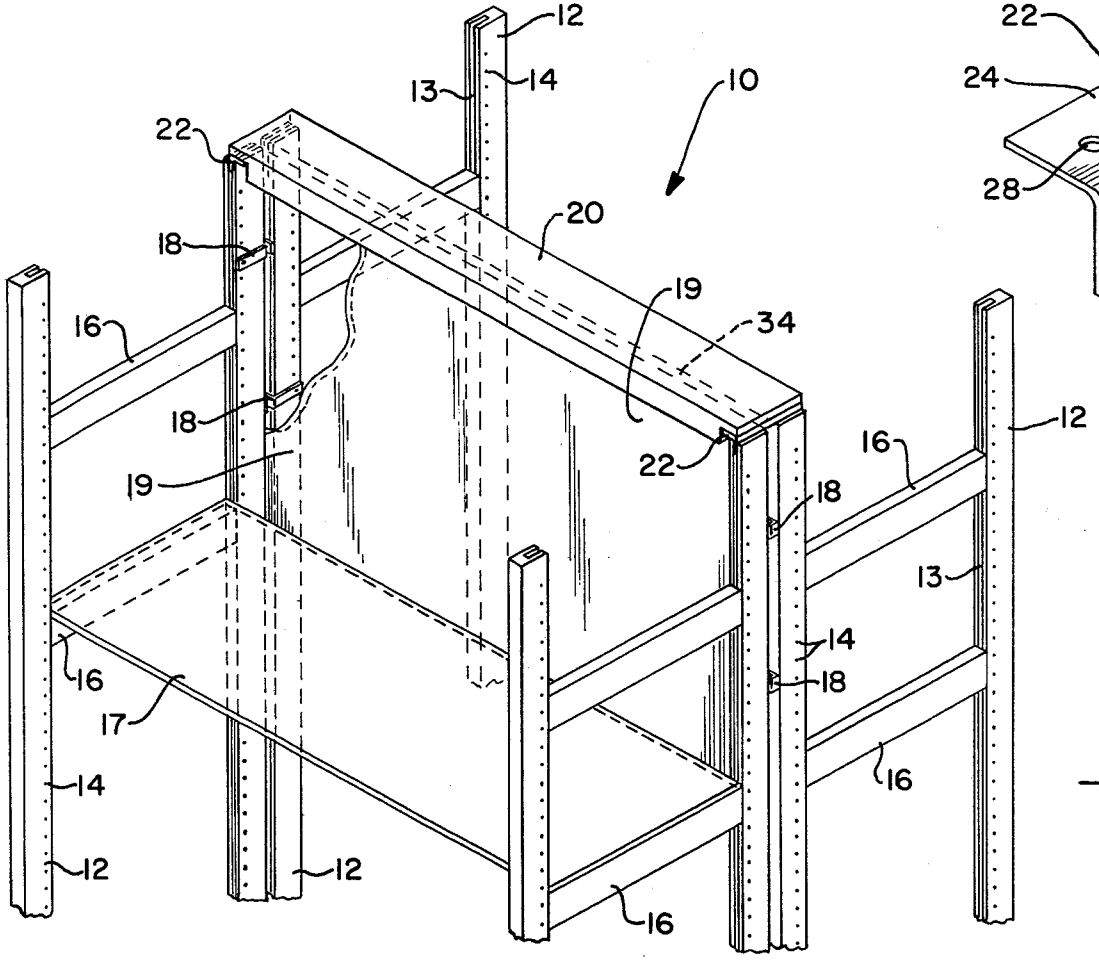
FIG. 1 is an isometric view of a display device.

The various structural elements of the invention, as well as the overall appearance and method of interconnection of the elements can be seen in the figures. FIG. 1 represents an isometric view of the invention wherein the display device is indicated generally by the number 10. A number of uprights 12 having a plurality of apertures 14 at the positions indicated are joined in pairs by means of braces 16. The paired uprights are then joined together by means of panel retainer clips 18 and a gondola cap 20 which fits over the four inner uprights as shown in the figure. A tang 22 on either end of the gondola cap 20 provides securement of the cap to the uprights. Use of the retainer clips 18 and the gondola cap 20 provides a rigid structure and, as will be described more fully hereinbelow, enables quick assembly and disassembly.

The braces 16 can be secured to the uprights by various well known means, however, a preferred method is to use tongue and grooving, wherein grooving 13 is located in the uprights 12. Apertures 14 are then positioned so that they extend through the upright at the location of the grooving, allowing a bolt (not shown), passing through the aperture to have an exposed portion within the groove. The bolt, or for that matter any type of dowel positioned within the aperture, can secure the brace by simultaneously passing through an aperture (not shown) in the "tongue" of the brace which registers with an aperture 14 in the groove. The bolt of course may itself be secured by means of a nut or other device such as a cotter pin. If a number of apertures are present, it will be apparent that the braces can be located at any point along the length of the uprights and that a plurality of braces may be used, as shown in the figure. An alternative preferred method is to use staples instead of bolts or dowels to secure the braces.

Figure 2:
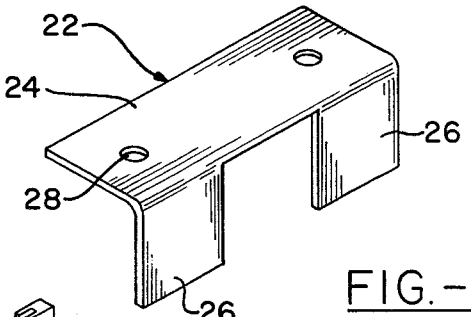
FIG. 2 is an isometric view of a specialized bracket used in construction of the display device.
Figure 3:
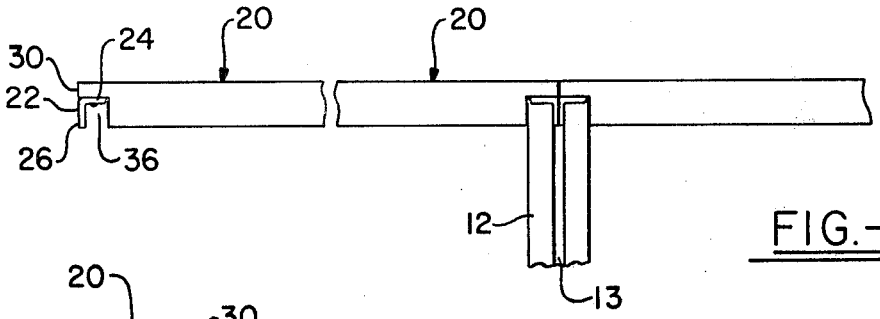
FIG. 3 is a side view of a securement means for the display device.

The grooving in the uprights also facilitates the attachment of the gondola cap 20. While attachment may be by any number of conventional means such as screws, nails, or the like, preferably the gondola cap utilizes a tang 22 on either end as mentioned earlier. FIG. 2 illustrates in detail the structure of the tang, while FIG. 3 illustrates how the gondola cap is utilized in securing the upright. The tang has a base portion 24 and two retention bars 26. The tang base is attached to the gondola cap by means of bolts, screws, or other securement devices which pass through apertures 28. Gondola cap 20 has at each end a recess 36 which, as shown in FIG. 3, receives an upright 12. The retention bars 26 are friction fitted into the grooving 13 on each of the two center uprights. The beam 30 of the gondola cap is thus nearly flush with the upright, being separated only by the width of the tang base.

Figure 4:
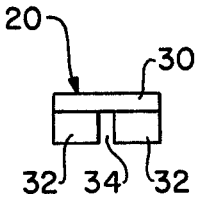
FIG. 4 is an end view of the same securement means.

As shown in FIGS. 3 and 4, the gondola cap, in addition to the beam 30 has two support members 32, slightly shorter in length than the beam and which thereby creates recesses 36. A channel 34 separates the two supports and provides a means of securement for a central panel which will be described hereinafter.

As shown in FIG. 3, a second gondola cap 20 can be inserted in the uprights 12. In this manner a number of display modules can be attached together in series. Naturally, the groove 13 must be wide enough to accomodate both tangs. This extension process may go on indefinitely, creating a display of any desired length merely by adding additional tangs and two pairs of uprights. Because the gondola caps, in the preferred embodiment, are friction fitted to the uprights, it is a simple matter to remove them by hand and thus decrease the length of the display when such is required. Despite this relatively easy method of construction and disassembly, the use of the gondola caps and tangs provides an extremely rigid structure having a strength proportional to the length of the display.

Figure 5:
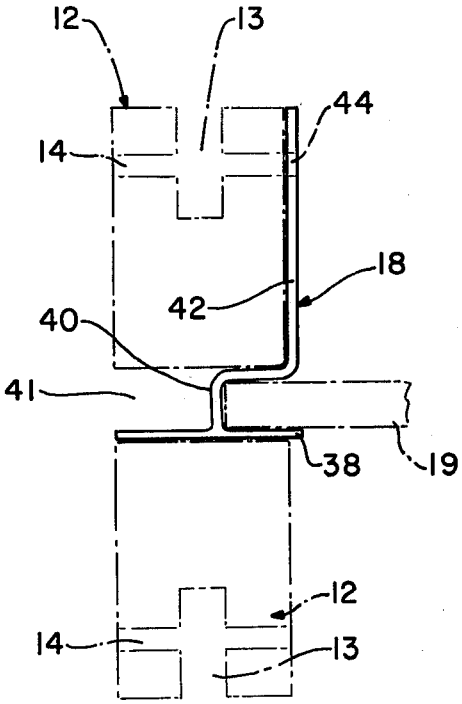
FIG. 5 is a top view of a retainer clip used in the invention.
Figure 6:
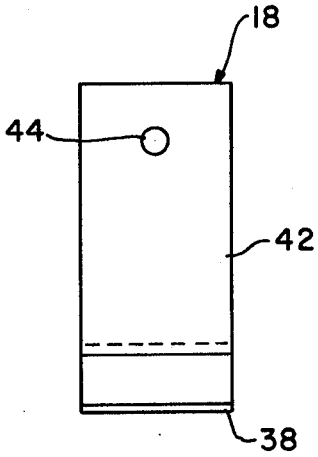
FIG. 6 is a side view of the same retainer clip.

An alternative means of increasing the size of the display is to use additional upright pairs secured together by the panel retainer clips 18. The structure of these clips can be seen in detail in FIGS. 5 and 6. The clip 18 has a base section 38 which abuts against the edge of an upright 12 while a retention bracket 42 is secured to a second upright 12 by means of a bolt or screw (not shown) passing through an aperture 44. A spacing bar 40 separates the two uprights, leaving a gap 41 on either side of the spacing bar.

Returning to FIG. 1, it can be seen that due to the standardized construction of the uprights 12 a series of additional uprights can be appended to any of the outer four uprights by using additional panel retainer clips 18 and additional braces 16. One of the apertures 14 in the uprights is conveniently registered with the aperture 44 in the retainer clip to provide securement. The clips 18 are generally alternated in their securements to the uprights 12, that is, half the clips are secured to one upright and the other half to the other upright in alternating fashion.

The gap 41 produced by the spacing bar 40 provides a retention means when a panel 19 is inserted between the central uprights. Use of such a panel which may be constructed of aperture board, fiberboard, or the like, provides a division of the display which may be advantageously used in displaying different types of items, or in the case of aperture board, in attaching various items thereto. Naturally, the panel is inserted prior to attachment of the gondola cap 20, the latter providing additional securement by means of the channel 34 which receives the upper edge of the panel.

Shelving can be attached to the braces 16 as shown in FIG. 1 and used conveniently for storage of display items. As mentioned previously, the location of braces 16 can readily be altered thereby changing the height of the shelves. The shelves are preferably removably secured to the braces to permit easy disassembly of the display. Well known means such as screws, adhesive pads, or the like may be used. It will be appreciated that the length of the shelf 17 should be such that, when the display is extended through use of additional gondola caps and uprights, there is room enough on the braces 16 for support for more than one shelf. An alternative method of securing the shelves is by use of end pieces which will be discussed hereinafter in more detail in the description of a second embodiment.

From the description above, it is apparent that, for the display device to function properly, the pieces must fit together with a reasonable degree of precision. While this normally would entail a fair amount of expense and effort, the fact that all the pieces are standardized allows their mass production to close tolerances at relatively low cost. Except for the panel retainer clips and the tangs, the remaining pieces may be readily constructed of wood or wood composite material which can be precision cut using jigs and other well known wood working devices. Indeed, use of the invention entirely dispenses with the need for on site wood working, thus obviating the need for skilled trades such as carpentry. The only tool required for assembly are a screwdriver and/or a simple set of wrenches.

Figure 7:
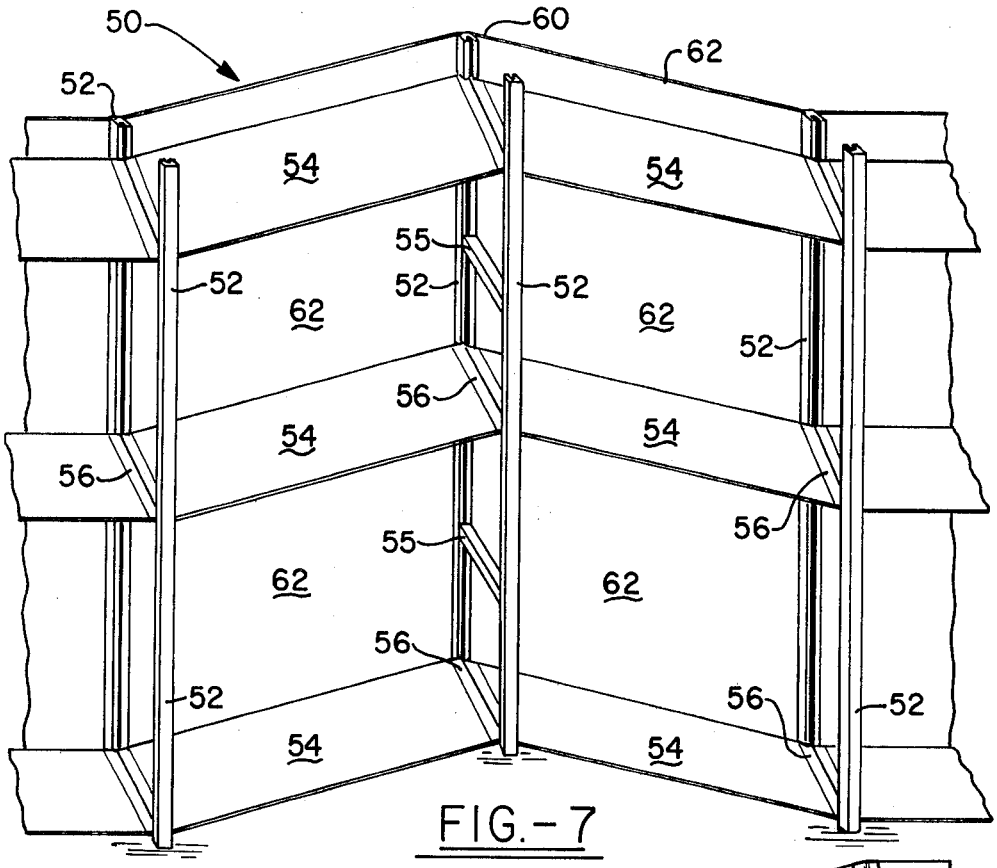
FIG. 7 is a rear view of a second embodiment of the invention.
Figure 9:
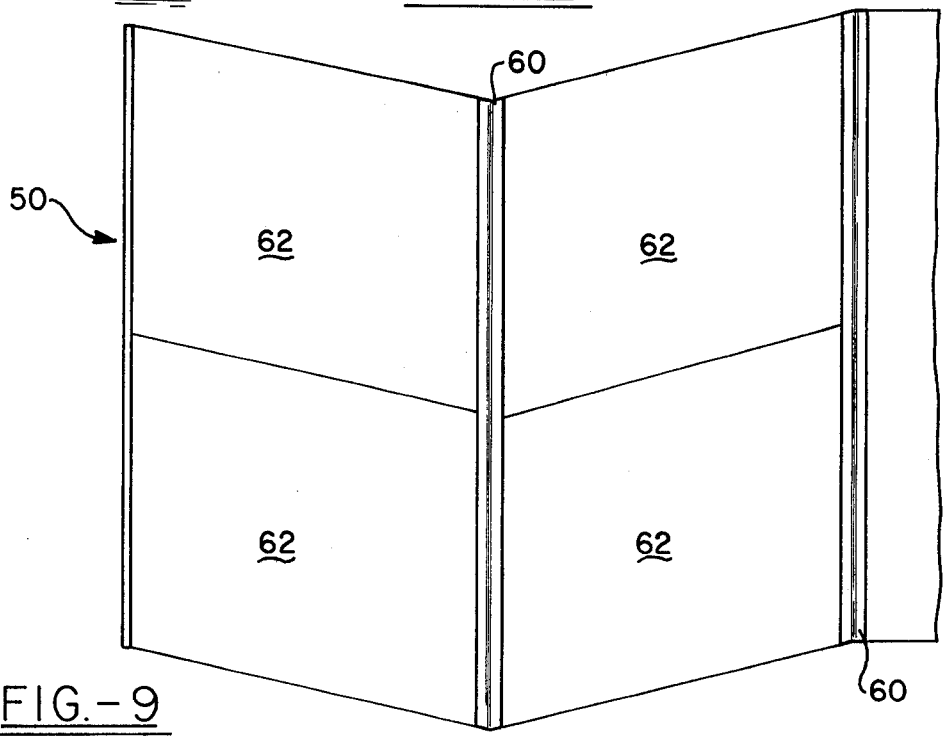
FIG. 9 is a front view of the second embodiment.
Figure 8:
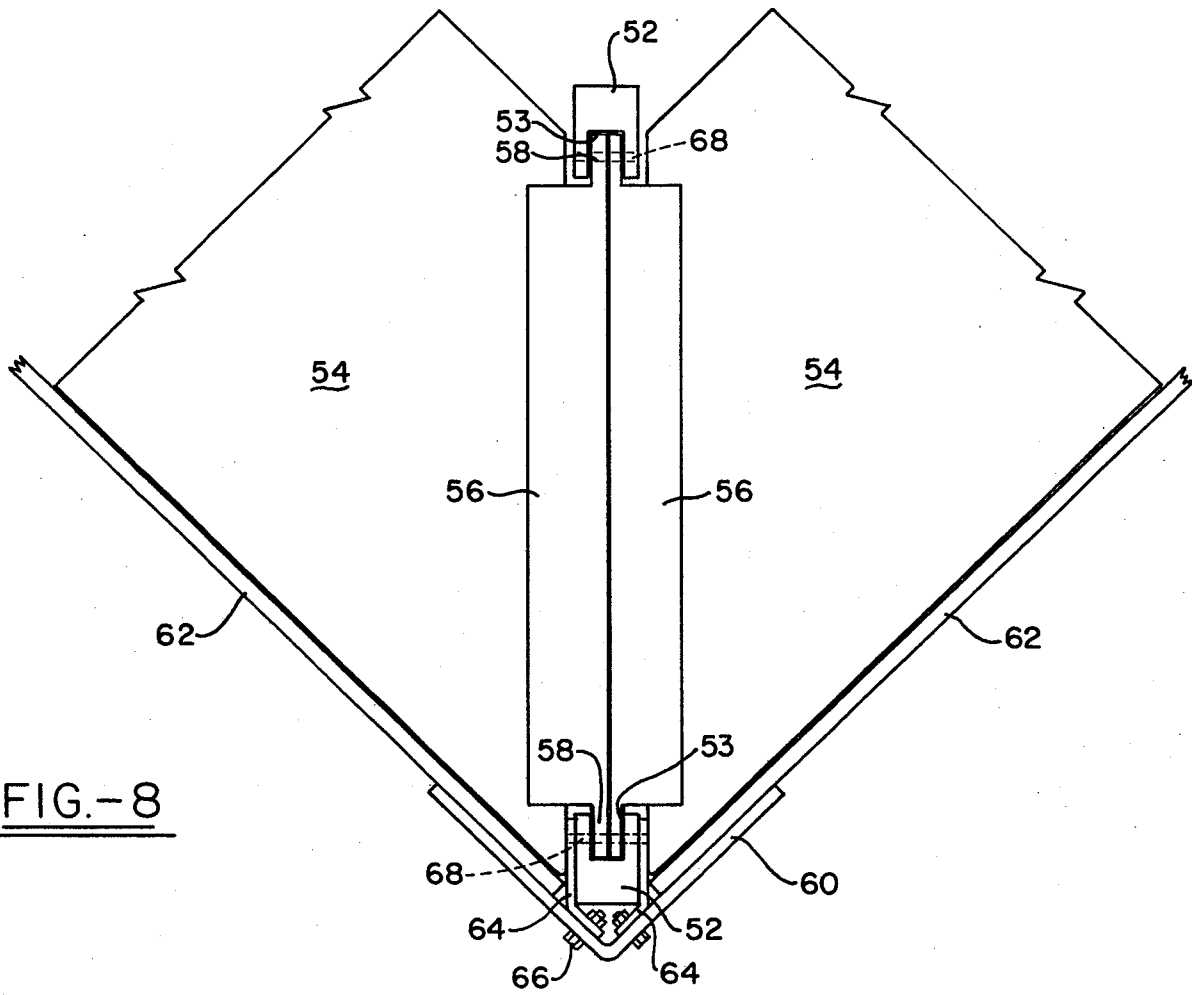
FIG. 8 is a top view of the means for securement in this second embodiment.

A second embodiment of the invention having equal ease of assembly and disassembly is illustrated in FIGS. 7, 8, and 9. A series of uprights 52 having braces 55 are identical in design to uprights 12 previously described, are utilized in a similar fashion. Braces 55 join pairs of the uprights. A number of shelves 54 can be secured to the uprights in the manner most clearly indicated in FIG. 8. Shelves 54 may be rectangular in shape, but are preferably in the form of parallelograms.

At each end of the shelf 54 is attached an end bracket 56 having bracket extensions 58. The bracket extensions provide support for the shelf 54 by resting on a dowel or bolt passing through apertures 68 in the upright, the latter being located to expose the dowel or bolt within a grooving 53 similar to grooving 13. Bracket extension 58 thus functions as a "tongue" which is received by the grooving 53.

The mounting brackets 64 secure an upright 52 to a section of angled material 60 made preferably of steel or aluminum. Various well known means can be used to secure the brackets 64 to the angled material 60, such as, for example, bolts 66. The brackets 64 are preferably attached to the upright 52 by means of dowels or bolts passing through one of the apertures 68 located in the upright.

With reference to FIG. 9, it can be seen that the frontal area of the display device is covered by a plurality of display surfaces 62, which are secured in place by friction fit between the angled material and the shelves 54. The location of the surfaces 62 can be seen in FIG. 8. The edges of the display surfaces are of course hidden by the angled material thus providing an attractive outer appearance.

The display surfaces can be constructed of a variety of materials having a suitable outer finish which is selected based on intended use. A preferred use of the display surface is for the attachement of advertizements, posters, and the like. For this purpose, the display surface is conveniently comprised of particle board or cork board with a matting such as dyed burlap attached over the board. Other surfaces may of course be used for decoration or utility. Because the display surfaces are secured by a friction fit, they may be easily interchanged without the use of specialized tools.

As with the first embodiment, the length of the display device 50 can be varied at will to accomodate a variety of applications. A parallogram or zig zag shape provides a greater structural integrity to the display. Generally the angle of the parallogram is from about 10 to about 180 degrees and preferably from about 95 to about 135 degrees.

In this second embodiment, display items can be stored behind the display surface on the shelving 54 until needed, at which time they can be placed on the top shelving to provide high visibility.

For the foregoing description it will be apparent that the invention, in its alternative embodiments, supplies a high degree of versitility to the field of merchandise display. Further, the invention is constructed of readily available materials such as wood, and where appropriate, metal such as steel and aluminum. The height of the display device can vary from about 4 to 8 feet. While taller displays can be made, 8 feet has been found to be the maximum practical length for display.

The foregoing description, while complying with the statutory requirement of disclosure of the best mode and preferred embodiments, shall not be construed as constituting the entire scope of the invention. Accordingly, changes and modifications can be made to the invention without departing from the scope thereof, a true measure of which will become apparent from a reading of the attached claims.

What is claimed is:

1. A display device, comprising:

at least four pairs of upright members, each pair having two uprights adjoined by braces extending between facing edges thereon, each upright of said pair having a groove along said facing edge;

a plurality of retainer clips securing said upright pairs in series fashion, forming thereby two units of two pair each;

a gondola cap joining said units in parallel array, having a tang at each end friction fitted into the said grooves of said uprights joined by said retainer clips; and at least a shelf secured in horizontal fashion to one of said braces in each of said units.

2. A display device according to claim 1, wherein the device further comprises a panel disposed in perpendicular fashion between the said upright pairs of each said unit, the upper surface flush with said gondola cap;

wherein said uprights contain a plurality of apertures for removable securement of said braces to said uprights.

3. A display device according to claim 2, wherein said retainer clips are secured to said uprights through said apertures.

* * * * *